United States Patent [19]

Fischer

[11] 4,397,235

[45] Aug. 9, 1983

[54] MULTI-PRINTING MODE ROTARY PRINTING MACHINE

[75] Inventor: Hermann Fischer, Augsburg, Fed. Rep. of Germany

[73] Assignee: Man-Roland Druckmaschinen Aktiengesellschaft, Offenbach am Main, Fed. Rep. of Germany

[21] Appl. No.: 360,065

[22] Filed: Mar. 22, 1982

[30] Foreign Application Priority Data

Apr. 25, 1981 [DE] Fed. Rep. of Germany ..... 3116504

[51] Int. Cl.[3] ..... B41F 7/26; B41F 5/24; B41F 35/00

[52] U.S. Cl. ..... 101/141; 101/DIG. 28; 101/148; 101/352; 101/425

[58] Field of Search ..... 101/137, 141, 142, 147, 101/148, 177, 217, 349, 350, 351, 352, 425, DIG. 28

[56] References Cited

U.S. PATENT DOCUMENTS

| | | | |
|---|---|---|---|
| 3,043,214 | 7/1962 | Christhoff | 101/148 X |
| 3,516,354 | 6/1970 | Heimlicher | 101/148 X |
| 3,561,357 | 2/1971 | Schinke | 101/350 X |
| 3,890,898 | 6/1975 | Fischer | 101/148 |

FOREIGN PATENT DOCUMENTS

| | | | |
|---|---|---|---|
| 418437 | 10/1934 | United Kingdom | 101/142 |

OTHER PUBLICATIONS

"Litho Switch", *The British Printer,* Aug. 1975, p. 31, Anon.

Euroman—M.A.N. -Roland Druckmaschinen—Letterpress Convertible Printing Press.

*Primary Examiner*—Edgar S. Burr
*Assistant Examiner*—David A. Wiecking
*Attorney, Agent, or Firm*—Frishauf, Holtz, Goodman, Woodward

[57] ABSTRACT

To permit, in addition to selectively raised letter printing or direct lithographic printing on a single plate cylinder (2), additionally flexo printing, the damping system (4) utilized for direct lithographic printing is filled with flexo printing ink rather than with damping liquid, and the direction of rotation of the plate cylinder, and an associated impression cylinder, together with direction of passage of a printed web or sheet (28) is reversed so that flexo printing ink is applied by the damper, positioned in advance of the printing or impression line (29) to a flexo printing plate on the plate cylinder (2) whereas, for direct lithographic printing, damping liquid is first applied to the plate cylinder for subsequent application of ink by an inker (8) in engagement with the plate cylinder which is removable from engagement when used in flexo printing. The roller brush (20) is positioned between the damping system (4) and the inker (3), engaged with the flexo printing plate for flexo printing, but out of contact with the plate cylinder for direct lithographic printing. For raised letter printing, the damper application roller (12) is disconnected from contact with the plate cylinder, and the roller brush (20) operating in the differential speed with respect to the plate cylinder, is used to clean the raised portions of the printing plate thereon. The system permits extension of existing selective DiLitho or raised letter printing also to flexo printing.

6 Claims, 3 Drawing Figures

(RAISED LETTER)

(FLEXOPRINT)

(DI-LITHO)

MULTI-PRINTING MODE ROTARY PRINTING MACHINE

Cross reference to related application, assigned to the assignee of this application, the disclosure of which is hereby incorporated by reference, U.S. Ser. No. 360,068, filed Mar. 22, 1982, by the inventor hereof (claiming priority German Application P 31 16 505.2, Apr. 25, 1981.

The present invention relates to a multi-printing mode printing machine and more particularly to a machine which can operate in two respectively opposite directions of rotation, and in which the printing machine has a plate cylinder and an impression cylinder, a damper and an inker; and which can be selectively used for raised letter printing or direct lithography, also known as DiLitho printing.

BACKGROUND

A machine of the type to which the present invention relates is in commercial use and described by a publication by the assignee of the present invention.

The "Euroman" machine can be selectively used for raised letter printing or DiLitho printing. It includes a slinger-type damping system and an inking system. The machine is not, however, suitable for use in other printing modes.

THE INVENTION

It is an object to expand the utility and applicability of the basic machine structure of the "Euroman" type to permit, in addition to selective use for raised letter or DiLitho printing, additionally, operation in flexo printing. The arrangements should be such that existing disposition of machine elements should be utilizable as far as possible, and, further, that existing machines can be retrofitted for expanded utility, including flexo printing.

Briefly, the damper is so arranged that it can be used selectively with flexo print ink, which, as well known, dries very quickly; a roller brush is provided selectively engageable with the plate cylinder for raised letter and flexo printing, the roller brush additionally being engageable with the damper for raised letter printing to clean the damper system and with elements of the damper for flexo printing to distribute to distribute flexo print ink and clean the cylinder thereof, the brush being removable from engagement with the plate cylinder for DiLitho printing, in which operation the inker is applied to the plate cylinder. For raised letter printing, the damper is removed from contact with the plate cylinder; for flexo printing, the damper—then containing flexo print ink—is engaged with the plate cylinder while the inking system which would be used for raised letter or DiLitho printing is placed out of contact with the plate cylinder.

The machine of the present invention permits utilization of the same machine, selectively, for raised letter, DiLitho or flexo printing. Components and elements present in an existing machine can continue to be used. The inking with flexo print ink is simple, by utilizing the existing damper otherwise used for DiLitho printing. The roller brush provides clean printing due to the cleaning effect thereof when working with plates of raised printing images. Even a large number of printing editions can be satisfactorily handled.

DRAWINGS

Figure 1:
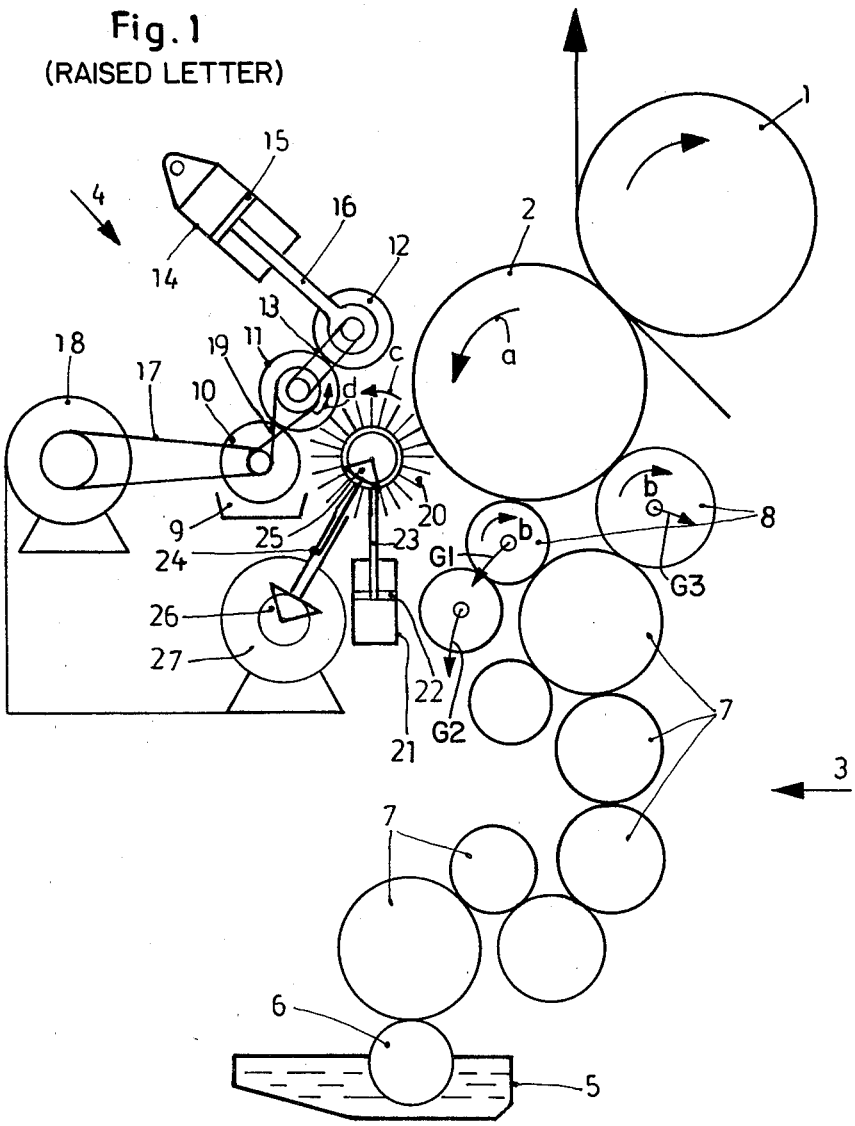
FIG. 1 is a schematic side view of the printing machine, arranged for raised letter printing.

The printing system has an impression cylinder 1, a plate cylinder 2, an inker 3, and a damper 4. The inker 3 has an ink trough 5, a pick-up or ductor roller 6 dipping into the trough 5, and a roller train shown schematically by rollers 7. The rollers 7 supply ink to application rollers 8. The application rollers 8 are supported in the side walls of the machine (not shown) to be movable, as schematically indicated by the arrows G1, G2, G3 so that they can be selectively engaged with the plate cylinder 2 or removed therefrom. Other inking systems than the one shown may be used. Movement of the ink application rollers 8 and such other distribution or milling rollers as may be in contact therewith can readily be accomplished, as well known, by journalling the respective rollers in eccentrically positioned bearings or the like.

The damper 4 includes a trough 9 to receive liquids therein. A pick-up roller 10 partially dips into the liquid in trough 9. The pickup roller 10 is in contact with a transport roller 11. Transport roller 11 may be axially oscillating. Transport roller 11 transfers liquid from trough 9 to an application roller 12. The application roller 12 is supported at its axial ends in links 13 which are pivotable about the axis edge of rotation of the transport rollers 11, so that, upon moving the roller 12 about the axis of rotation of the transport roller 11, the application roller 12 can be placed in surface engagement with the plate cylinder 2, or removed therefrom. Moving force to the application roller 12 is supplied by a piston-and-cylinder assembly 14, 15, 16, for example hydraulically operated, and pivotably connected to the links 13.

The pickup roller 10 is driven by a belt drive 17 from a drive source 18, shown as an electric motor which, preferably, is of the reversible and speed-controllable type. The pickup roller 10 further is connected over a belt drive 19 with the transport roller 11. The belt drive 19 is so arranged that the transport roller 11 operates with a higher circumferential speed than the pickup roller 10. Other motion transmitting elements, such as gears and the like, may be used.

In accordance with a feature of the invention, a brush 20 is provided which can be selectively positioned in engagement with the plate cylinder 2 and/or the transport roller 11. The placement of the brush 20 is determined by a cylinder-piston arrangement 22, for example hydraulically operated, and connected over a link 23 with the shaft, or axis of rotation of the brush 20. The brush 20 is driven via two bevel gears 25, 26 from a further drive source, shown as an electric motor 27 which, preferably, is speed controllable and reversible. A telescopic shaft 24 is provided to permit rotating the brush 20 although its position has changed from that shown in FIG. 1.

Various other types of dampers can be used, for example a four-roller damper. The only requirement is that, in operation, all the rollers are in continuous surface contact.

The present invention is applicable to various types of printing machines, having various numbers of printing systems; all, or only a portion of the printing systems may be arranged for printing in the three different printing modes referred to, raised letter printing, flexo printing, or direct lithography.

Operation—Raised Letter Printing, with Reference to FIG. 1:

The plate cylinder 2 is rotated in the direction of the arrow a. The application rollers 8 if the inker 3 are in surface contact with the plate cylinder 2. They rotate in the direction of the arrow b. The application rollers thus provide ink to the raised elements of the plate cylinder. The brush 20 is also in engagement with the plate cylinder 2. The plate cylinder 2, rotating in the direction of a, is cleaned first by the bristles of the brush roller 20 before being inked by the ink application rollers 8. The brush 20 can be rotated either in the direction of the arrow c or in the opposite direction; if rotating in the direction opposite the arrow c, the surface speed thereof should differ from the surface speed of the plate cylinder 2. The essential feature is only that a speed difference exists between the surface speed of the plate cylinder 2 and the ends of the bristles of the brush roller 20.

In a preferred form, the brush roller 20 additionally is in surface contact with the transport roller 10. A cleaning fluid or solvent is introduced into the trough 9. The direction of rotation of the transport roller 11 can be that of the arrow d, for example, or in the opposite direction. The essential feature is that a speed difference appears between the ends of the bristles of the brush 20 and the surface of the transport roller 11. The transport roller 11, thus, is being cleaned by the brush. The application roller 12 is out of engagement from the plate cylinder 2, as seen in FIG. 1.

Figure 2:
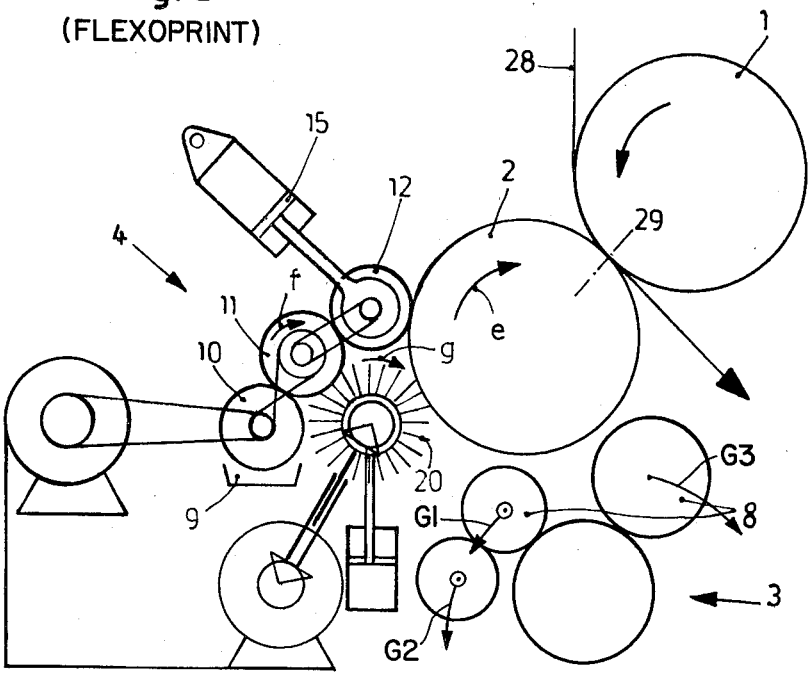
FIG. 2 is a fragmentary side view of those portions of the machine of FIG. 1 necessary for an understanding of the invention, when the machine is set up for flexo printing.

Flexo Printing, with reference to FIG. 2:

The direction of rotation of the plate cylinder 2 is reversed and now changed to that of arrow e. The paper web 28 is passed through the printing station in reverse direction with respect to that of FIG. 1, and the impression cylinder 1 likewise rotates in reverse direction. For flexo printing, the application rollers 8 of the inker are removed from the plate cylinder 2, by moving the application rollers and such associated milling rollers or the like, in the direction of the arrows G1, G2, G3. The piston 15 has hydraulic pressure fluid applied thereto, and the application roller 12 of the damper 4 thus is placed in surface engagement with the plate cylinder 2. The damper 4 is so driven that the transport roller 11 rotates in the direction of the arrow f, with a surface speed which is at least approximately equal to the surface speed of the plate cylinder 2. The brush roller 20 is placed in the same position as for raised letter printing, that is, to clean the flexo print plate on plate cylinder 2 in advance of application of flexo print ink by the application roller 12 and, further, to clean the transfer roller 11 of the damper. In contrast to lithographic printing, however, the trough 9 of the damper is filled with flexoprint ink which, as well known, is volatile and dries quickly. The pickup roller 10 provides ink to the transport roller 11 which, in turn, provides the flexo ink to the application roller 12 and then on the plate cylinder. The arrangement is so made that the application roller 12 applies the flexo print ink close to the printing line 29, that is, the line between the plate cylinder 2 and the impression cylinder 1. The brush roller 20 is positioned to clean the raised printing image on the flexo printing plate on the plate cylinder 2. It may rotate in the direction of the arrow g or in opposite direction, and then with a surface speed which differs from the surface speed of the plate cylinder 2.

Figure 3:
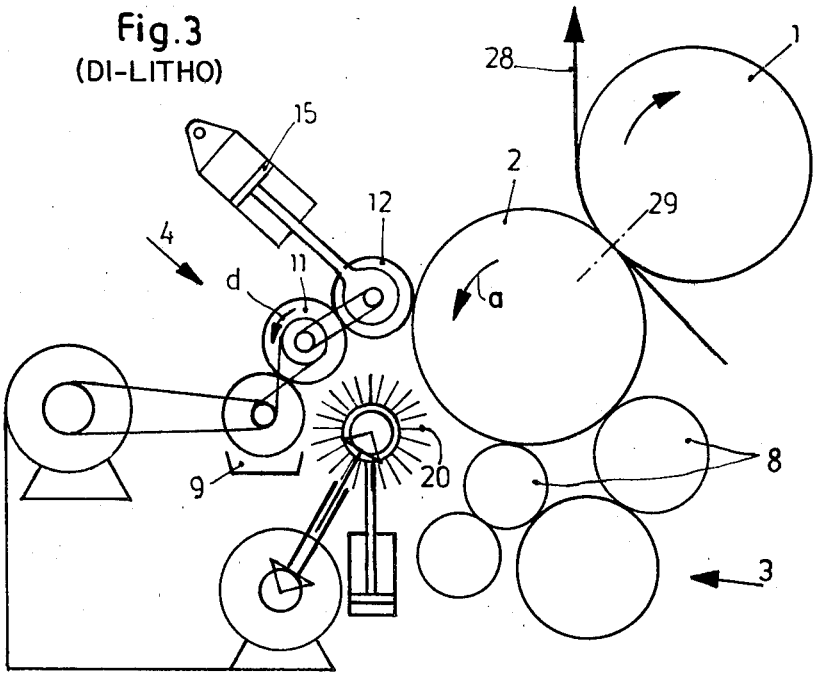
FIG. 3 is a view similar to FIG. 2 when the machine is set up for direct lithographic printing.

Direct Lithography, with Reference to FIG. 3:

The direction of movement of a sheet of paper or web of paper through the printing machine is the same as for raised letter printing, as seen in FIG. 3, and the plate cylinder 2 and impression cylinder 1 rotate in the direction as in raised letter printing. The direct lithography plate is inked by the application rollers 8 of the inker 3, in contact with the plate 2. The damper is so driven that the transport roller 11 rotates in the direction of the arrow d. In this mode of printing, the trough 9 of the damper receives damping liquid, for example water. Looked at in the direction of rotation of the plate cylinder 2, and starting from the printing or impression line 29, the plate cylinder 2 is first damped by the damper application roller 12, in surface contact with the DiLitho or direct lithographic plate thereon; thereafter, the subject matter which carries printing information is inked by the application rollers 8. The brush 20 is placed out of contact with respect to the plate cylinder so as not to smear the printing information thereon, and likewise is out of contact with the damping liquid applied by the damper 4.

Various changes and modifications may be made within the scope of the inventive concept.

I claim:

1. Multi-mode rotary printing machine having a printing cylinder system (1, 2) rotatable, selectively, in either direction of rotation including a plate cylinder (2);

an impression cylinder (1);

an inking system (3) having at least one ink application roller (8);

a damping system (4) having a liquid transfer roller (11), a liquid application roller (12), and means (9, 10) applying liquid to the liquid transfer roller for transfer to the application roller and then to the plate cylinder, means to selectively rotate the plate cylinder in either a first direction (a) or a second direction (e), and comprising, in accordance with the invention means for selectively operating the printing machine in one of the printing modes defined by:

(a) raised letter printing mode;

(b) flexo printing mode;

(c) direct lithographic printing mode, including a roller brush (20);

the ink application roller (8) being adjustably positionable in ink transferring relationship with the plate cylinder, or out of said ink transferring relationship;

first positioning means (14–16) selectively controlling the position of the liquid application roller (12) for selective engagement or disengagement with the plate cylinder;

second positioning means (21, 22) selectively controlling the position of the roller brush (20) for surface contact or out of surface contact with the plate cylinder;

and wherein the liquid supply means of the damping system comprises a liquid trough (9) and a pickup roller (10) at least partially dipping into the liquid trough and being positioned in liquid transfer relation to the liquid transfer roller (11);

and wherein (FIG. 1) for printing in the raised letter printing mode, the first positioning means are controlled for disengagement of the liquid application roller (12), the second positioning means are controlled for engagement of the roller brush with the plate cylinder, and the ink application roller (8) is positioned in ink transferring relation to the plate cylinder (2), the plate cylinder being rotated in the first direction (a)

for printing in flexo printing mode (FIG. 2), the first positioning means (14–16) controls engagement of the liquid application roller (12) on the surface of the plate cylinder (2), the second positioning means (21, 22) controls engagement of the roller brush (20) with the plate cylinder, the ink application roller (8) of the inker (3) being positioned out of ink transferring relationship with the plate cylinder, the plate cylinder being rotated in the second direction (e)

and wherein the liquid trough contains flexo printing ink; and for direct lithographic printing (FIG. 3)

the first positioning means controls engagement of the liquid application roller (12) with the plate cylinder, the second positioning means (21, 22) controls disengagement of the roller brush (20) from the plate cylinder, the ink application roller (8) of the inker (3) being positioned in ink transferring relationship with the plate cylinder (2), the plate cylinder being rotated in the first direction (a)

and wherein the liquid trough contains offset damping liquid.

2. Machine according to claim 1, where the direction of rotation of the plate cylinder (2), the impression cylinder (1), the rollers of the inking system (3) and the rollers of the damping system (4) are selectively controllable;

and wherein the ink application roller (8) of the inking system and the liquid application roller (12) of the liquid system (4) are located along the circumference of the plate cylinder (2) such that, for flexo printing, any axial line on the printing cylinder, after passing the impression line (29) first passes the position of the ink application roller (8) and thereafter comes in surface contact with the liquid application roller (12);

and, for operation in the direct lithographic printing mode, the direction of rotation of the respective cylinders and rollers is reversed so that, after leaving the impression line (29), the plate cylinder first comes in contact with the liquid application roller (12) for damping liquid and thereafter with the ink application roller (8) of the inking system.

3. Machine according to claim 1, wherein said second positioning means (21, 22) permits simultaneously positioning the roller brush (20) in surface engagement with the plate cylinder (2) and with the liquid transfer roller (11).

4. Machine according to claim 1, further comprising an individual, rotation reversible and speed controllable drive (27) operatively connected to said roller brush (27).

5. Machine according to claim 1, wherein, when operating in the raised letter mode, said liquid trough (9) contains a cleaning liquid or solvent.

6. Machine according to claim 5, wherein said second positioning means (21, 22) is selectively positionable to engage the roller brush in surface contact with the plate cylinder and with the liquid transfer cylinder.

* * * * *